US010040524B1

(12) United States Patent
Collins

(10) Patent No.: US 10,040,524 B1
(45) Date of Patent: Aug. 7, 2018

(54) SUSTAINED RELEASE WATER MARKING DEVICE FOR SEARCH AND RESCUE

(71) Applicant: Calvin Collins, Summerton, SC (US)

(72) Inventor: Calvin Collins, Summerton, SC (US)

( * ) Notice: Subject to any disclaimer, the term of this patent is extended or adjusted under 35 U.S.C. 154(b) by 0 days.

(21) Appl. No.: 15/581,415

(22) Filed: Apr. 28, 2017

(51) Int. Cl.
*B63B 45/00* (2006.01)
*B63C 9/20* (2006.01)

(52) U.S. Cl.
CPC ..... *B63B 45/00* (2013.01); *B63C 9/20* (2013.01)

(58) Field of Classification Search
CPC ..... B63B 45/00; B63C 9/20
USPC ..... 116/200–201, 209–211; 252/301.16; 436/56, 164, 172
See application file for complete search history.

(56) References Cited

U.S. PATENT DOCUMENTS 2,295,594 A 9/1942 Mills
2,387,244 A 10/1945 Compton et al.
2,464,834 A * 3/1949 Taylor ..... B63B 22/003 102/391
2,474,537 A * 6/1949 MacLeod ..... B64D 25/20 116/211
2,519,825 A * 8/1950 De Ment ..... B63B 51/04 116/18
2,675,776 A * 4/1954 Tuve ..... B63B 51/04 114/234
2,716,961 A * 9/1955 Manheim ..... B63C 9/20 114/234
2,783,209 A 2/1957 Pessel
3,049,091 A * 8/1962 Carroll ..... B64D 25/20 116/211
3,095,851 A * 7/1963 Lager ..... B63B 22/10 116/211
3,157,890 A * 11/1964 Mellon, Jr. ..... B63B 22/12 116/211
3,170,438 A * 2/1965 Coleman ..... B63B 22/24 116/211
3,179,600 A * 4/1965 Brockett ..... B01F 5/06 503/200
3,280,549 A * 10/1966 Jui-Cheng ..... B63C 9/20 116/211
3,297,585 A * 1/1967 Hayden ..... G01N 31/22 116/211
3,507,620 A * 4/1970 Gurney ..... E21B 47/1015 166/252.6

(Continued)

FOREIGN PATENT DOCUMENTS

WO WO 00/47042 8/2000

*Primary Examiner* — R. A. Smith
*Assistant Examiner* — Tania Courson
(74) *Attorney, Agent, or Firm* — Dority & Manning, P.A.

(57) ABSTRACT

A device that can provide sustained release of a detectable marker into a surrounding body of water as well as methods of forming the device and methods of using the device. The devices and methods can be utilized to locate people or vessels, e.g., by search and rescue personnel, following the disabling of air or water vessels of any type or size on/in a body of water. The devices include multiple, separated layers that each include a detectable marker, e.g., a fluorescent dye. The dye-containing layers are separated from one another and sequentially released over a predetermined controlled period of time and as such the device can continue to release a detectable marker over an extended period of time into surrounding water.

21 Claims, 4 Drawing Sheets

(56) References Cited

U.S. PATENT DOCUMENTS 3,539,794 A * 11/1970 Kennerly ..... C09K 11/07 206/219
3,669,891 A * 6/1972 Greenwood ..... A23L 3/045 424/10.1
3,676,359 A 7/1972 Garrett et al.
3,749,311 A * 7/1973 Hruby, Jr. ..... B05B 17/08 239/17
3,839,639 A 10/1974 Hughes
3,851,171 A * 11/1974 Saniford ..... E21B 47/1015 250/259
3,859,680 A * 1/1975 Larsen ..... B63B 51/00 116/211
3,940,612 A * 2/1976 Sparlin ..... G01V 5/08 250/258
4,055,399 A * 10/1977 Parrish ..... E21B 43/16 166/252.6
4,527,504 A * 7/1985 Byerley ..... G08B 21/088 116/209
4,783,314 A * 11/1988 Hoots ..... G01F 1/704 210/696
4,809,638 A 3/1989 Kolesar et al.
5,199,374 A * 4/1993 Blanchette ..... B63B 22/12 116/209
5,405,416 A * 4/1995 Swinton ..... C09B 67/0072 116/211
5,602,088 A 2/1997 Tokosh et al.
6,129,036 A * 10/2000 King ..... B63C 9/155 116/206
6,260,508 B1 * 7/2001 Morse ..... B63C 9/0005 116/211
7,384,795 B2 * 6/2008 Lagwinski ..... B82Y 15/00 422/50
7,695,335 B2 * 4/2010 Ricciuti ..... H04B 10/118 441/89

* cited by examiner

SUSTAINED RELEASE WATER MARKING DEVICE FOR SEARCH AND RESCUE

BACKGROUND

Search and rescue operations over water bodies has many challenges, not the least of which is that the vessel and/or people being sought can move great distances following their last known location. As such, markers have been developed in an attempt to more quickly locate aircraft, ships, and people following accidents over/in bodies of water. These markers tend to be either electrically based (e.g., battery powered signal transmitters) or optically based (e.g., fluorescent dyes).

Electrically based markers are ideal as long as they continue to operate, but can be rendered unusable if severely damaged by impact or if critical components become wet. Fluorescent dyes show promise as universal markers as they will not be impaired by water contact and can be detected at a relatively great distance in both daylight and night search and rescue operations. Unfortunately, most fluorescent dye systems depend upon the ability of someone to release the dye, which may not be possible if the individual is incapacitated. Moreover, once the dye is released, it can dissipate relatively quickly and if the search is not successful within that limited time window, odds for successful recovery decrease rapidly.

What are needed in the art are markers for use in search and rescue operations over water bodies. More specifically, what are needed are devices that can automatically release a detectable marker into surrounding water over a sustained period of time and that can thereby provide a long lasting detectable trail to the target of the search.

SUMMARY

According to one embodiment, disclosed is a device for providing sustained release of a detectable marker in a body of water. A device can include a container and a plurality of layers within the container. A first layer can include a first detectable marker (e.g., a fluorescent dye) and a second layer can include a second detectable marker (e.g., the same or a different fluorescent dye). At least one of the first and second layers can include the detectable marker admixed with a dissolvable matrix. The device can also include an intermediate layer separating the first and second layers. The intermediate layer can optionally include sub-layers. For instance, an intermediate layer can include a wadding layer, e.g., a cellulose-based layer that is relatively slow to wet, as a first sub-layer and an effervescent layer as a second sub-layer that is located beneath the first sub-layer.

The device can optionally include additional layers. Beneficially, layers that include a detectable marker admixed with a dissolvable matrix can be designed with a predetermined dissolution rate, with the matrices of some (e.g., lower) layers dissolving more slowly than those of other (e.g., upper) layers and thereby slowing the release of the detectable marker contained therein.

Also disclosed is a method for forming the device. For instance, the method can include forming a first layer within a container, the first layer including particles that include a first detectable marker admixed with a buoyant, dissolvable matrix. The method also includes forming an intermediate layer within the container and a second layer within the container, the intermediate layer being between the first and second layers and the second layer including a second detectable marker that can be the same or different as the first detectable marker. The method can optionally include forming additional layers within the container, capping the container, attaching the container to a vessel or a floatation device, and forming the particles that are then placed in the container.

Also disclosed is a method for releasing a detectable marker into a body of water over a sustained period of time. According to the method, upon wetting, a first, upper layer held in a container can release a detectable marker into the surrounding water. Following, water can contact an intermediate layer and the intermediate layer can dissolve or be discharged from the container over/following a predetermined period of time. For instance, the intermediate layer can include an upper sub-layer that is a wadding layer and a lower sub-layer that is an effervescent layer. After the leading edge of the absorbed water reaches the bottom of the wadding layer, water can contact the effervescent layer causing a gas to form. Pressure from the gas formation can discharge the wadding layer from the container. Following discharge of the intermediate layer, water can contact a second marker layer. This layer can include a detectable marker admixed with a dissolvable matrix. Following contact with the water, and as the matrix dissolves, the detectable marker can be released from the matrix and into the surrounding water. Additional lower layers can be subsequently contacted with the water and additional marker released into the water from those lower layers following discharge of the upper layers from the container.

BRIEF DESCRIPTION OF THE FIGURES

A full and enabling disclosure of the present subject matter, including the best mode thereof to one of ordinary skill in the art, is set forth more particularly in the remainder of the specification, including reference to the accompanying figures in which.

Figure 1:
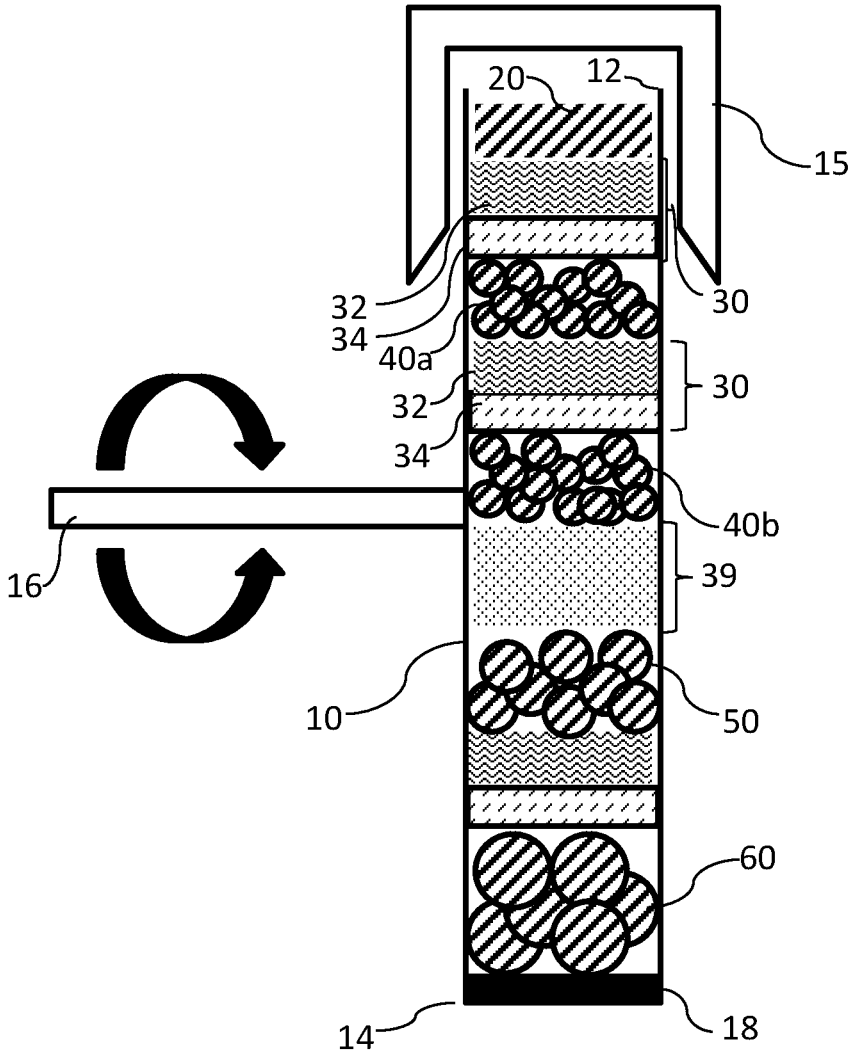
FIG. 1 schematically illustrates one embodiment of a device as disclosed herein.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

In general, the present disclosure is directed to a device and method that can provide sustained release of a detectable marker into a surrounding body of water. The devices and methods can be beneficially utilized to locate people or vessels, e.g., by search and rescue personnel, following the disabling of air, land, or water vessels of any type or size on/in a body of water. Beneficially, the devices can continue to release a detectable marker over an extended period of time into surrounding water of any river, lake, sea, ocean, or any other type of water body. Moreover, the devices can operate automatically at the surface of the water or at any depth beneath the surface. As such, the devices can operate even in those situations in which a vessel is submerged below the water surface and/or individuals are incapacitated.

FIG. 1 illustrates one embodiment of a device. As shown, the device can include a container 10 and a series of layers 20, 30, 40, 50, 60 and sub-layers 32, 34 held within the container 10. The container 10 can be of any convenient size, with the preferred size generally depending upon the particular application for the device. For instance, in those embodiments in which a device is designed for attachment to a large vessel, e.g., an ocean-going vessel or an aircraft, the container can be quite large, from about 1 foot to about 3 feet in length as measured from the upper, open end 12 of the container 10 to the lower end 14 of the container 10, or even larger in some embodiments. Alternatively, in those embodiments in which a device is intended for individual use, for instance as a component of or attachable to an individual floatation device, or for use with a smaller vehicle, e.g., an automobile or a small watercraft, the container 10 can be smaller, for instance, from about 4 inches to about 12 inches in length. Likewise, the cross-sectional shape and size of the container 10 can vary (e.g., from about 2 inches to about 12 inches in cross-sectional width in some embodiments). In one embodiment, the container 10 can be cylindrical in overall shape. The container and any separable components of the container (e.g., the attachment and cover discussed below) can also include identification information, e.g., registration information to associate the container, cover, etc. with a particular vessel.

The material of construction for the container 10 can likewise vary, depending upon the particular application of the device. For instance, the container 10 can be formed of a metal (e.g., stainless steel) or a plastic, e.g., a polyvinyl chloride (PVC)-based material, or a composite polymer (e.g., a fiber reinforced polymeric material such as a fiberglass), or any other water impermeable material.

The container 10 can include an attachment 16 that can secure the container 10 to a vessel, a floatation device, outerwear, or the like. The attachment can be a permanent attachment or can be such that an individual can detach the container from the securement, for instance in order to activate the device. Optionally, the attachment 16 can be capable of pivoting in one or more degrees of freedom, as indicated by the directional arrows on FIG. 1. The ability to pivot or rotate the container 10, can ensure that the container 10 can achieve a proper orientation and release the contents into the surrounding water upon activation (e.g., upon disabling of the vessel), even in those cases in which the container 10 is completely submerged, and even when submerged to a great depth. Similarly, a container 10 may include additional weight 18 at the lower end 14 of the container 10 in order to ensure the desired orientation of the container both prior to and following activation of the device. For instance, prior to activation, an additional weight 18 can prevent excessive pivoting of the device due to e.g., ocean swells, which could lead to loss of the contents. Following activation and partial or complete submerging, the additional weight 18 can help to orient the device and allow release of the contents as designed.

The container 10 can also include a cover 15 that can protect at least the upper, open end 12 of the container 10. The cover 15 can be attached to the container 10 or can loosely sit upon the container 10, as desired. In any case, the cover 15 can be designed to automatically be removed upon submerging of the container 10 into surrounding water. In some embodiments, the cover can remain attached to the container following removal from the open end 12, e.g., via a tether. In one embodiment, the cover 15 can loosely sit over the upper end 12 of the container 10 and can be formed of a water impermeable and buoyant material (e.g., a buoyant plastic or foam). Upon submerging of the container 10 into surrounding water, the cover 15 can float off of the upper end 12 of the container (optionally remaining tethered to the container), exposing the interior contents to the surrounding water and activating the device. In another embodiment, the cover 15 can include a film that covers the upper, open end 12 of the container. The film of the cover 15 can be formed of a water soluble material, e.g., a polyvinyl alcohol, that can dissolve upon contact with the surrounding water to expose the interior of the container 10 to the surrounding water and thereby activate the device.

Inside the container 10 is a series of layers 20, 30, etc. at least a portion of which include a detectable marker. The detectable marker can include any material that upon release into surrounding water can be detected by search and rescue personnel. In general, the detectable marker can be optically detectable, but the devices are not limited to optically detectable materials, and materials detectable by other means, e.g., radioactive decay, electromagnetic signals outside of the optically detectable range, etc. are encompassed herein.

Optically detectable markers include any materials that can be detected in one or more of the ultraviolet (UV), visible, or infrared (IR) spectra. In one embodiment, an optically detectable marker can be a fluorescent dye as is generally known in the art. Useful fluorescent dyes can include, without limitation, rhodamine dyes such as Rhodamine 7B and Rhodamine 6G, Pentacyl Brilliant Pink B, fluorescein dyes including sodium fluorescein as well as other salts of fluorescein, Brilliant Sulfoflavine FF, Genacryl Orange G, Genacryl Orange R, Genacryl Red 68, Genacryl Yellow 3G, Genacryl Yellow 56 and the like. Virtually any dye that is suitable for use as a sea surface dye marker would be suitable for use in the device. By way of example, one fluorescent detectable marker as may be contained in the container 10 and as commonly used by the U.S. Navy is fluorescein sodium salt. This organic compound has a very high fluorescence quantum efficiency and is an excellent organic detectable marker.

Figure 2:
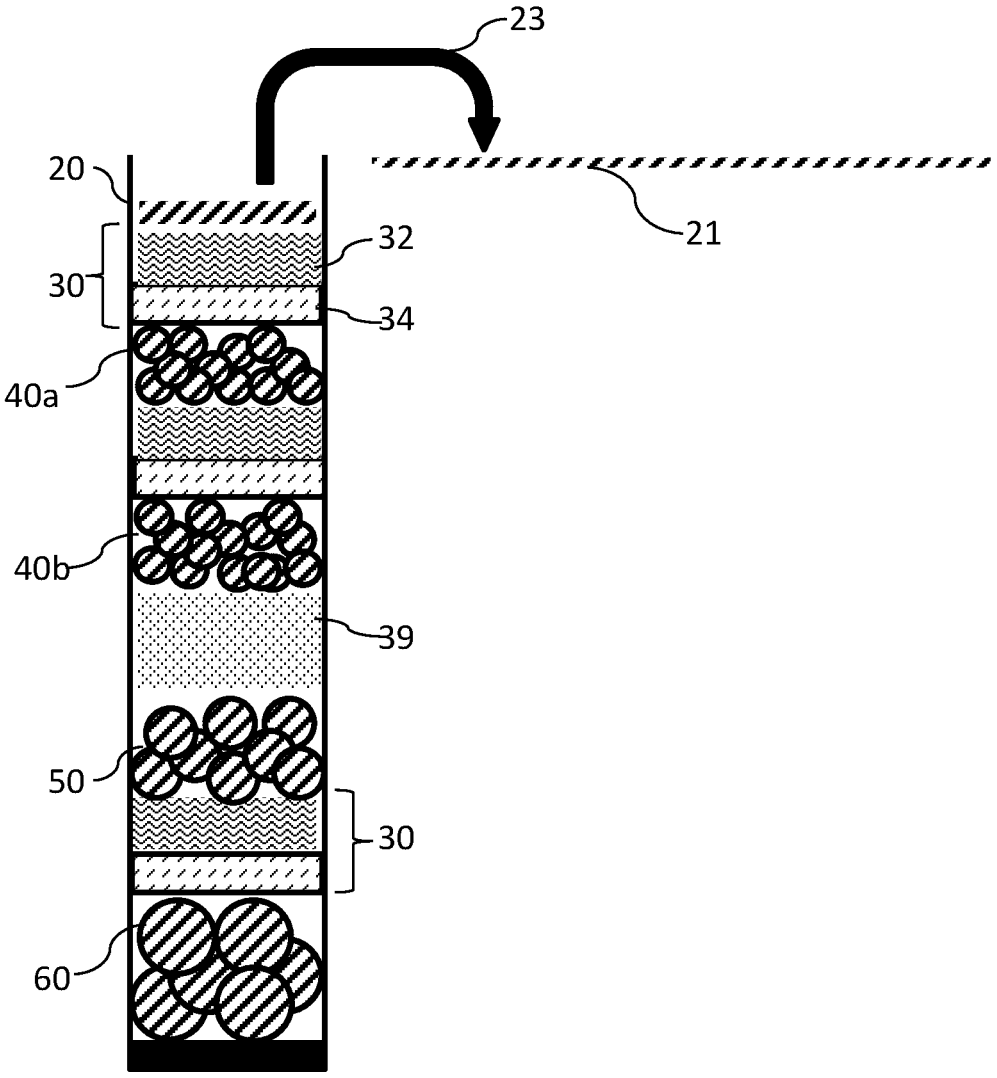
FIG. 2 illustrates release of an upper layer of the device of FIG. 1 into surrounding water.

In the embodiment of FIG. 1, the upper-most layer 20 within the container 10 includes a detectable marker such as a fluorescent dye for immediate release upon interaction with surrounding water. For instance, and as illustrated in FIG. 2, following removal of the cover 15, and upon submerging of the container 10 in the water, the detectable marker of the upper-most layer 20 can be discharged 23 into the surrounding water to form a thin, expanding layer 21 on the water surface.

The container 10 need not be completely and constantly submerged for activation of the system. Activation of the system requires at least intermittent flow of water in and out of the container, but not necessarily complete and constant submersion. Accordingly, a device can be activated automatically upon removal of the cover 15 and water flow in and out of the container, e.g., due to wave motion, or upon submerging of the container in the water. In addition, activation of the system is not limited to automatic activation, and the system can alternatively be manually activated. For example, device can be manually activated by removal of the cover 15 and placement of the device into the surrounding water so as to allow water flow in and out of the interior of the container and at least intermittent contact between the contents and the surrounding water.

The detectable marker of the upper-most layer 20 can be in a powder or tablet form as is known in the art such that, upon interaction with the water, the dye can dissolve relatively quickly to form a detectable signature at the surface of the water. FIG. 2 illustrates the dispersal 23 of the detectable marker of the layer 20 from the interior of the container 10 to the surrounding water to form a thin, widespread layer 21 on the surface of the surrounding water. In the embodiment of FIG. 2, the upper end 12 of the container 10 is substantially at the level of the surrounding water, but this is not a requirement as discussed previously, and the container 10 can be totally or partially submerged in the water, provided that the surrounding water has at least periodic access to the interior of the container 10.

Beneath the layer 20 is an intermediate layer 30 that in this embodiment includes two sub-layers 32, 34. Intermediate layer 30 is located between layers 20, 40 each of which include a detectable marker. Intermediate layer 30 provides for a delay between the discharge of the detectable marker contained in the upper layer 20 into the surrounding water and the discharge of the detectable marker contained in the lower layer 30 into the surrounding layer. Thus, intermediate layer can serve as a temporary water barrier that can slow the encroachment of water into the lower layers of the device. While intermediate layer 30 can include a detectable marker, e.g., an amount of a fluorescent dye in a powder form, this is not a requirement of the device and in one embodiment, intermediate layer 30 can be free of any detectable marker.

In addition, the upper-most layer of the device is not limited to a layer that includes a detectable marker, and in some embodiments, the upper-most layer can be formed of the components that form an intermediate layer. For example, a first layer can be a layer that is discharged following activation of the device as described for the intermediate layers, but contains little or no detectable marker.

Figure 3:
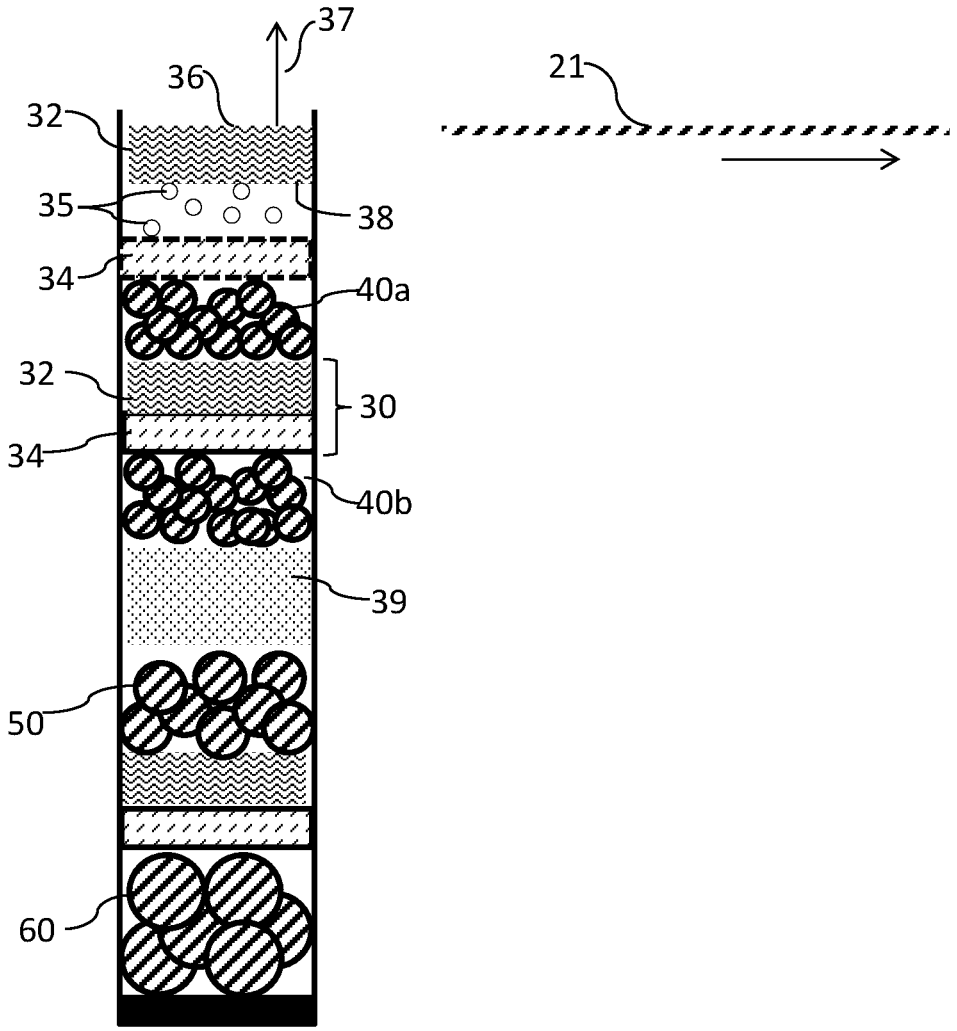
FIG. 3 illustrates the release of an intermediate layer from the device of FIG. 1.

FIG. 3 illustrates one embodiment for discharge of an intermediate layer 30 from a container 10. The upper sub-layer 32 is in the form of a wadding that is tightly packed into the container 10 and through which the surrounding water encroaches relatively slowly. The wadding can include natural or synthetic materials or a combination thereof that can slowly wet to allow water to encroach toward the lower layers of the container. For example the wadding can be formed of a tightly packed cellulosic and/or lignocellulosic based material, e.g., paper, wood chips, etc. that can be slow to wet. Moreover, the sub-layer 32 can be formed of a single structure, e.g., a 'plug' or can be formed of a plurality of materials, fibers, chips, particles, etc., or combinations thereof that can be packed together to form a slow-wetting layer, optionally including adhesives that can absorb water or dissolve slowly upon contact with water.

The materials, size, density, etc. of the sub-layer can be varied in order to design the wetting characteristics of the sub-layer 32. For example, the sub-layer can be designed such that encroaching water can pass from an upper surface 36 of the sub-layer 32 to a lower surface 38 of the sub-layer over a period of time of about 5 minutes to about 60 minutes. Thus, as the layer 21 that includes the detectable marker of a previous layer disperses and moves away from the container 10 on the water surface, the water slowly encroaches through the sub-layer 32 toward the lower sub-layer 34 over a pre-determined period of time.

Sub-layer 34 includes an effervescent material. Upon contact with water, the effervescent material can form a gas 35, e.g., carbon dioxide. The increased pressure due to the formation of the gas can force the upper sub-layer 32 out of the container 10 as indicated by the directional arrow 37.

Effervescent materials as are generally known in the art are encompassed for use in forming a sub-layer 34. By way of example, a sub-layer can include a carbonate or bicarbonate salt or a combination thereof (e.g., a sesquicarbonate), which upon interaction with water can form carbon dioxide. In one embodiment, a carbonate-based sub-layer 34 can also include a solid soluble acidic substance such as citric acid, an alkali metal acid citrate, tartaric acid, an alkali metal bisulfate, or the like, in conjunction with a bicarbonate, which can improve disintegration of the sub-layer 34 and interact with water in conjunction with the carbonate to form carbon dioxide.

In one embodiment, one or more of the intermediate layers can be in the form of a homogenous intermediate layer 39 that can be water soluble and thus dissolve over a period of time to provide a time delayed access of water between an upper layer 40*b* and a lower layer 50 that are located on either side of the intermediate layer 39. By way of example, a dissolvable intermediate layer 39 can include a water soluble polymer matrix, such as polyvinylpyrrolidone, polyacrylic acid, and the like. In general, a dissolvable intermediate layer 39 can include a water soluble polymer as may be produced from any water soluble monomer that can be polymerized to form a water soluble polymer. Suitable monomers can include, without limitation, acrylic acid, 2-hydroxyethylacrylate, vinyl pyrrolidone, N,N-dimethylacrylamide, etc. Additionally, copolymers, terpolymers, or any combination of water soluble monomers can be used, optionally in conjunction with non-water soluble portions as may be incorporated to control dissolution rate of the layer 39. As such, a water soluble intermediate layer 39 can be formed with a predetermined dissolution rate so as to control the time delay for water contact between marker layers 40*b*, 50 of a device.

Figure 4:
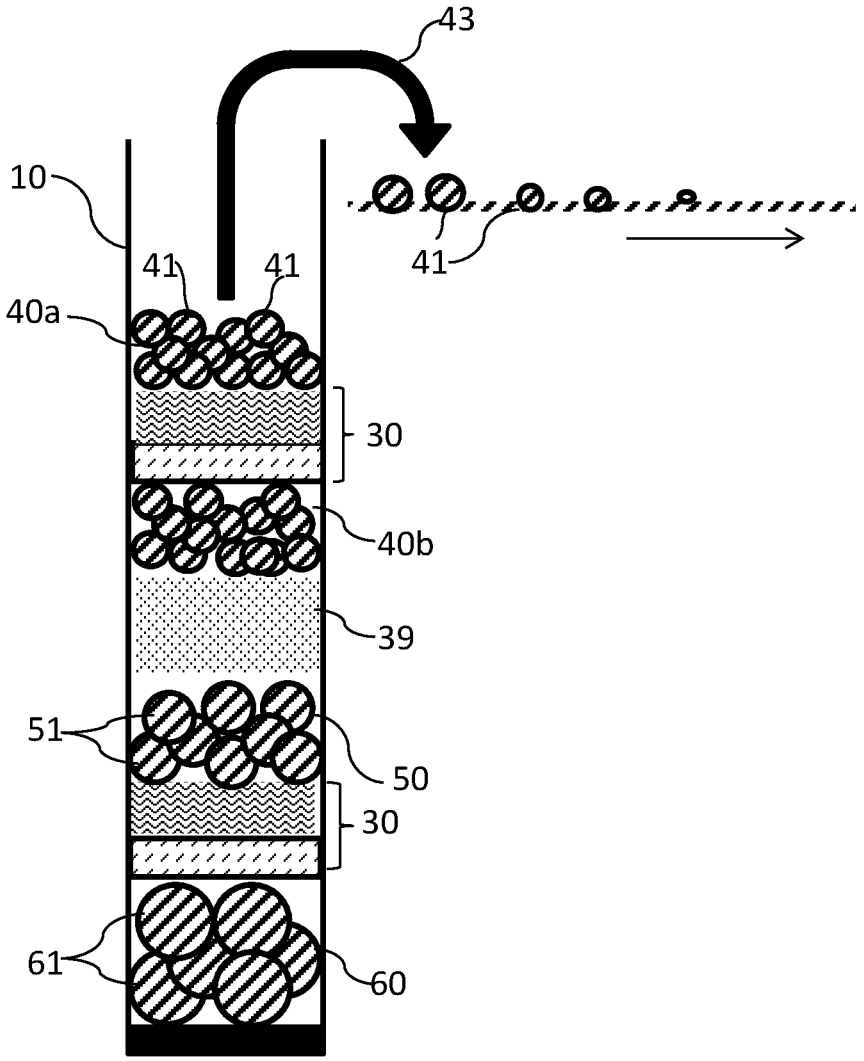
FIG. 4 illustrates the release from the device of FIG. 1 of a layer that includes a detectable marker admixed with a dissolvable matrix.

As illustrated in FIG. 4 following discharge and/or dissolution of the materials of an upper intermediate layer, water can contact a lower layer 40*a*. Layer 40*a* can include a detectable marker that can be the same or different as the detectable markers of other layers of the device. In addition, the detectable marker of layer 41*a* (as well as other layers of the device including the upper-most layer 20) can be incorporated in a buoyant, water soluble matrix. The buoyant water soluble matrix can be utilized to slow release of the detectable marker from the matrix. As such, not all of the detectable marker will contact the water upon interaction between the surrounding water and the layer 40*a*, and the detectable marker can be released from the matrix over time following this initial contact.

For example, and as illustrated in FIG. 4, the layer 40*a* include a plurality of particles 41 that include a detectable marker (e.g., a fluorescent dye) admixed with a buoyant, water soluble matrix. Upon contact with the surrounding water, the particles 41 can exit the container as at 43 and begin to dissipate over the surface of the surrounding water. As the particles 41 remain in contact with the surrounding water, the water soluble matrix can slowly dissolve. As this matrix dissolves, the detectable marker admixed within the particles 41 can then be released and begin to disperse over the surface of the surrounding water. Through incorporation of the detectable marker in a plurality of water soluble particles 41, the detectable marker of a single layer 40*a* can be released into the water over a period of time, rather than all at once upon contact of the layer 40*a* with the surrounding water. The particles 41*a* can be of any convenient size and shape. For instance, the particles 41*a* can be quite small, e.g., in the shape of small rods, flakes, spheres, etc. of about 0.5 inches or less in cross-section, about 0.25 inches or less in cross-section, or about 0.1 inches or less in cross-section. Such small particles may be preferred for upper layers of the device that will be released relatively soon after activation. For instance, small particles or flakes of a dissolvable matrix admixed with a detectable marker can be included in an upper-most layer 20 of a device in some embodiments. Larger particles are also encompassed, for instance in lower layers of a device. For instance, individual particles can have a cross-sectional size of about 0.5 inches or greater, 1 inch or greater, or 2 inches or greater in some embodiments. Devices for use with large vessels, such as ocean-going ships or passenger aircraft can include large, slow dissolving particles that can have cross sectional dimensions of several inches.

The buoyant, water soluble matrix material of the particles 41 can encompass any suitable ecologically-friendly material including natural materials, synthetic materials, or combinations thereof.

In one embodiment, a water soluble matrix can include a polyethylene glycol of suitable molecular weight that can form a wax-like, buoyant, solid particle that can be admixed with a detectable marker to form a particle. For instance, a polyethylene glycol (PEG) having a number average molecular weight of about 6000 or more can be utilized.

In one embodiment, a water soluble matrix can include one or more surfactants that can be admixed with the detectable marker and, upon dissolution, can optionally spread to form a coherent thin film over the surface of the water, which can improve detectability of the markers. Suitable surfactants can include a molecular structure that contains both a hydrophilic group (absorptive at the water surface) and a hydrophobic group that orients away from the water's surface. The hydrocarbon portion of the surfactant can generally contain about 12 or more carbon atoms, or about 18 or more carbon atoms in some embodiments, which can minimize evaporation and dissolution of the surfactant. Surfactants can be solid at ambient temperatures and may include natural or synthetic surfactants or combinations thereof including anionic, cationic, amphoteric, nonionic or zwitterionic surfactants.

Surfactants as may be utilized in forming a water soluble matrix can include, without limitation, polyoxyethylene alkyl ethers, polyethylene glycol esters of fatty acids, sorbitan esters of fatty acids, glyceride esters of fatty acids, fatty alcohols, salts of fatty acids (e.g., sodium salts of natural or synthetic fatty acids), synthetic surface-active agents (e.g. oleyl alcohol, isostearyl alcohol, oleyl ether, oleic acid cottonseed oil, etc.). Specific exemplary materials can include, without limitation, sorbitan trioleate, sorbitan monooleate, lauryl alcohol, sorbitan monolaurate, sorbitan dilaurate, sorbitan pelargonate, polyoxyethylene (POE) lauryl ether, POE tridecyl ether, PEG monooleate, PEG monolaurate, PEG dilaurate, oleyl alcohol, sodium cocoate, sodium tallowate, sodium palm kernelate, sodium palmitate, triethanolamine stearate, sodium cocoyl isethionate, sodium isethionate, sodium dodecyl benzene sulfonate, sodium cocoglyceryl ether sulfonate, and combinations thereof. Surfactant-based or other matrix compositions as are known in the art can be utilized in forming the buoyant, water soluble matrix. By way of example, and without limitation, known compositions available under a variety of trade names such as Carbowax™ PEGs (e.g., Carbowax™ 6000), Nonisol™ 250, Sorbit™, Ivory®, Nacconol®.

Such compounds can have relatively low solubility in water to provide a longer dissolution time and slower release of the detectable marker, and can have high spreading pressures. As such, they can delay dissipation of the detectable marker admixed with the matrix, but upon dissolution can rapidly spread over the surface of water to form a thin, continuous coherent film even under adverse wind and wave conditions. In some embodiments, matrix materials can also exhibit wave damping characteristics and may be likened to an artificial sea slick, which can improve detectability of the marker.

The matrix material can include additional components and additives as are generally known in the art. For example, the matrix material can be foamed or otherwise include a high air content so as to increase buoyancy of the particles. One or more additives including, without limitation, dispersing agents (e.g., sodium keryl-aryl sulfonate), evaporation retarding agents (e.g., cetyl alcohol), stability enhancing agents (e.g., glycerin), anti-settling agents (e.g., copper resinate, magnesium silicate, etc.), and the like can be incorporated in the dissolvable matrix.

The detectable marker can be combined with the matrix material in any suitable fashion. For example, in one embodiment a detectable marker in the form of a powder can be mixed with a matrix material (e.g., as a particulate, a powder, or a liquid), and then the mixture (upon solidification if necessary) can be formed to the desired particulate size. For example, the components of the water soluble particles 41 can be blended together in a highly efficient manner without the use of a solvent in one embodiment. Batch and/or continuous blending techniques may be employed. For example, a mixer/kneader, Banbury mixer, Farrel continuous mixer, single-screw extruder, twin-screw extruder, roll mill, etc., may be utilized. The raw materials (e.g., surfactant, detectable marker, stabilizer, etc.) may be supplied to the blending device separately and/or as a blend.

Regardless, the materials may be dispersively blended at a shear/pressure and temperature sufficient to ensure adequate mixing, but without adversely impacting the physical properties of the components. Following, the materials may be formed to a desired size to form particles 41 for inclusion in a layer 40*a* held in a container 10. The particles 41 of a single layer 40*a* can all be essentially the same size and shape as one another, or a single layer can include a mixture of differently size particles, as desired. Inclusion of particles of different materials or sizes in a single layer can be utilized to adjust and control the dissolution rate of the matrices and thereby control the release period of the detectable marker contained within the particles.

Similarly, different layers of a device can release the detectable marker of the layers over different time periods and at different rates. For example, in the illustrated embodiment, layers 40*a* and 40*b* include particles 41 of essentially the same size. As such, the detectable marker(s) of these layers can dissipate over the surrounding water sequentially to one another (i.e., the detectable marker of layer 40*a* will be released to the surrounding water prior to the detectable marker of layer 40*b*), and over the course of a similar time period to one another. However, as shown, the particles 51, 61 of the lower layers 50, 60, are progressively larger. As such, the particles of these layers will dissolve over progressively longer time periods following water contact and release into the surrounding water, thereby extending the release of the detectable marker in the surrounding water both over time and distance from the point of release.

Similarly, and as discussed previously, the time delay between water contact of each successive maker-containing layer (20, 40*a*, 40*b*, etc.) can be modified as desired. For example, the materials, thickness, density, etc. of the successively lower intermediate layers 30 can be modified so as to increase the time delay between release of the detectable marker(s) of each successive layer.

By providing for sustained release of the detectable marker(s) carried in the devices, both through the delay provided by the dissolvable matrices as well as the delay provided by the intermediate layers, disclosed devices can extend the release of detectable markers in both distance and time. As such, the disclosed devices can provide longer lasting and longer distance trails for search and rescue personnel to follow in coming to the aid of vessels and people in need.

While certain embodiments of the disclosed subject matter have been described using specific terms, such description is for illustrative purposes only, and it is to be understood that changes and variations may be made without departing from the spirit or scope of the subject matter.

What is claimed is:

1. A device for providing sustained release of a detectable marker in a body of water comprising:

a container;

a first layer within the container, the first layer comprising a first detectable marker;

a second layer within the container, the second layer comprising a second detectable marker admixed with a first buoyant, dissolvable matrix; and an intermediate layer separating the first and second layers, the intermediate layer comprising a first sub-layer and a second sub-layer, the first sub-layer comprising a water-absorbent material, the second sub-layer comprising an effervescent material that forms a gas upon contact with water.

2. The device of claim 1, wherein at least one of the first detectable marker and the second detectable marker comprise a fluorescent dye.

3. The device of claim 1, the water-absorbent material comprising a cellulose or a ligno-cellulose material.

4. The device of claim 1, the intermediate layer comprising a water-soluble polymer.

5. The device of claim 1, further comprising an attachment configured to attach the container to a surface.

6. The device of claim 5, wherein the attachment is capable of pivoting in one or more degrees of freedom.

7. The device of claim 1, further comprising a cover configured to protect an open end of the container.

8. The device of claim 1, the buoyant, dissolvable matrix comprising a surfactant.

9. The device of claim 1, further comprising a third layer that comprises a third detectable marker that can be the same or different as the first detectable marker and/or the second detectable marker and an additional intermediate layer separating the second and third layers.

10. The device of claim 9, wherein the third layer includes the third detectable marker admixed with a second buoyant, dissolvable matrix.

11. The device of claim 10, wherein the admixture of the second detectable marker and the first buoyant, dissolvable matrix are in the form of first particles, and/or the admixture of the third detectable marker and the second buoyant, dissolvable matrix are in the form of second particles.

12. The device of claim 9, further comprising one or more additional layers.

13. A method for releasing a detectable marker into a body of water over a sustained period of time, the method including locating the device of claim 1 on a vessel, wherein upon sustained or intermittent contact of the interior of the container with water, the first detectable marker of the first layer is discharged from the container, following which the water contacts the intermediate layer for a first period of time, following which the intermediate layer is dissolved and/or discharged from the container, and following which, the water contacts the second layer, upon which the second detectable marker is discharged from the container into the surrounding water whereupon the first buoyant, dissolvable matrix dissolves over a second period of time and releases the second detectable marker.

14. The device of claim 1, wherein the first detectable marker and the second detectable marker are the same material.

15. The device of claim 1, wherein the first detectable marker and the second detectable marker are different materials.

16. The device of claim 1, the first sub-layer comprising a material that dissolves upon contact with water.

17. The device of claim 1, the effervescent material comprising a carbonate salt, a bicarbonate salt, a citric acid, an alkali metal acid citrate, a tartaric acid, an alkali metal bisulfate, or a combination thereof.

18. A method for forming a water marking device comprising:

forming a first layer in a container, the first layer comprising a first detectable marker admixed with a first buoyant, dissolvable matrix;

forming a first sub-layer adjacent to the first layer, the first sub-layer comprising an effervescent material that forms a gas upon contact with water;

forming a second sub-layer adjacent to the first sub-layer such that the first sub-layer is between the first layer and the second sub-layer, the second sub-layer comprising a water-absorbent material; and forming a second layer adjacent to the second sub-layer such that the first and second sub-layers are between the first and second layers, the second layer comprising a second detectable marker.

19. The method of claim 18, the second layer comprising the second detectable marker admixed with a second buoyant, dissolvable matrix.

20. The method of claim 19, wherein the first buoyant, dissolvable matrix dissolves in water more slowly than the second buoyant, dissolvable matrix.

21. The method of claim 18, further comprising attaching the container to a vessel, a floatation device or outerwear.

* * * * *